US005350465A

United States Patent [19]

Walter et al.

[11] Patent Number: 5,350,465

[45] Date of Patent: Sep. 27, 1994

[54] METHOD OF MECHANICAL STRUCTURING OF ENDLESS PRESSING BANDS AND PRODUCT THEREOF

[75] Inventors: Robert Walter, Huerth; Walter Hueck, Luedenscheid, both of Fed. Rep. of Germany

[73] Assignee: Firma Eduard Hueck GmbH & Co. KG, Leudenscheid, Fed. Rep. of Germany

[21] Appl. No.: 954,919

[22] Filed: Sep. 30, 1992

[30] Foreign Application Priority Data

Oct. 23, 1991 [DE] Fed. Rep. of Germany ..... 4134976

[51] Int. Cl.[5] ..... C22C 38/34; C23F 1/00

[52] U.S. Cl. ..... 148/325; 420/34; 134/41; 204/129.75

[58] Field of Search ..... 134/41; 204/129.75, 204/130, 140, 141.5; 420/34; 148/325

[56] References Cited

U.S. PATENT DOCUMENTS

| | | | |
|---|---|---|---|
| 4,518,519 | 5/1985 | Lott et al. | 134/41 |

FOREIGN PATENT DOCUMENTS

| | | | |
|---|---|---|---|
| 2002175 | 8/1970 | Fed. Rep. of Germany . | |
| 1758052 | 3/1972 | Fed. Rep. of Germany . | |
| 2950795 | 6/1981 | Fed. Rep. of Germany . | |
| 59-89780 | 5/1984 | Japan | 134/41 |
| 1025991 | 1/1989 | Japan | 134/41 |
| 7014310 | 3/1971 | Netherlands | 148/325 |

*Primary Examiner*—Deborah Yee
*Attorney, Agent, or Firm*—Michael J. Striker

[57] ABSTRACT

An endless steel pressing band for continuous structure transfer of a surface designed to laminated products, wood chip boards and the like, is welded at a butt point and has an alloy which provides after the galvanic removing good and uniform structuring in welding seam zones, including alloying ingredients carbon 0–0.03%, silicon 2–4%, manganese 0.15–0.5%, chromium 11–14%, nickel 6–8%, and a balance of iron.

9 Claims, No Drawings

METHOD OF MECHANICAL STRUCTURING OF ENDLESS PRESSING BANDS AND PRODUCT THEREOF

BACKGROUND OF THE INVENTION

The present invention relates to a method of galvanic structuring of endless pressing bands.

More particularly it relates to a method in accordance with which a steel band with certain alloying ingredients, treated in an acid bath and provided with a welding seam is used for galvanic structuring of endless pressing bands.

Pressing bands are used for continuous manufacture of laminated products and for coating of wood chip boards. The surface structure of the pressing bands is transferred in a pressing step under the action of pressure and temperature to the laminated product or to the coated wood chip board. Fine grain structures, wood pore representation and other geometrical designs are used as impression structures. The structure supporting surface is in all cases the outer surface of the pressing band which is additionally coated with a wear resistant hard chromium layer to maintain the load during the pressure application in so-called multi-layer presses. Frequently in the pressing bands also the inner side is provided with such a hard chromium layer. During the operation also an upper band and a lower band are utilized. They run synchronously with one another, and the coated chip board or the respective press laminate is treated between the associated runs of both pressing bands.

Such endless pressing bands are usually produced from steel band material with a thickness of 1–2 mm. Both ends of the steel band are connected with one another by means of conventional welding processes, for example laser or plasma welding. After the formation of the welding seam the welding seam zone must be treated. The treatment is performed by grinding the welding beads with simultaneous removal of fusing residues in the heating zone or the material bead region. After the preparation works in the welding seam zone the endless row bands are finely ground over the whole outer and inner surfaces, and thereby each band obtains its own material thickness with high tolerance accuracy. In some cases, further surface treatments are provided, for example mirror finishing.

Conventionally, for the steel for the steel band material mainly austenitic and martensitic steels are used with predetermined alloying ingredients. In the case of the austenitic steel material the alloying ingredients include the following average values: carbon 0.1%, silicium 0.6%, manganese 1.4%, chromium 17.5%, nickel 7.5%. In the case of austenitic steels the material values include a pulling strength of approximately 1,200 $N/mm^2$, a yield point of 980 $N/mm^2$, an elasticity limit of 600 $N/mm^2$ and an elongation of 22%.

In the martensitic steels the alloying ingredients include the following average values: carbon 0.05%, silicium 1%, manganese 1%, chromium 13%, nickel 4%, and titanium 0.3%. The material values include a pulling strength of 1,080 $N/mm^2$, a yield point of 1,000 $N/mm^2$, an elasticity limit of 850 $N/mm^2$ and an elongation of 5%.

Sample pressing bands of martensitic and austenitic alloys with one or several welding seams within an endless band were provided for experiments first with an etching-resistant printing ink in form of a design pattern having selectively a grain design or wood pore design. The sample band was suspended in a conventional acid immersion bath, and therefore as known a metal removing takes place on the metal-blank points which are free from the printing ink. Thereby the later printing image is produced. This metal removing process positively exposes the welding seam zones. After finishing the metal removing process in the immersion bath, a non-uniform structural image is recognized on all pressing bands in the welding seam zone. Undesired bead-like elevations in the welding seam zones are visible, each possibly can be traced back to the fact that in the direct welding seam zone a lower etching speed in the acid bath takes place than in the remaining welding seam-free regions.

In other sample bands instead of the bead-shaped elevations in the welding seam regions, wedge-shaped depressions in the welding seam zones were formed. This can probably be traced back to the fact that at these locations the etching speed was higher than in the remaining regions. The explanation for these measuring results in the same immersion bath but for different band samples can be probably found in the fact that different hardness conditions existed over the cross-section of the welding seam. Despite numerous comparative tests of endless steel band samples obtained commercially, advancements in the practice to produce proper structure image in the region of the welding seam zones were obtained. Invariably these bands lead during later pressing of the end products to visible marks on the press laminates or the coated chip plates.

In accordance with another known structuring methods disclosed in the German reference DE-OS 2,950,795 the attempt is made to avoid the above described problems in the region of the welding seam zones. In this method a metal layer is applied by galvanization on the welding seam zone and is thicker than the later etching engraving. The disadvantage of this method is however that the application of the galvanic layer which practically serves as a later structure supporting layer is expensive. Since the ductility of the galvanic layer on the pressing band is not always error free in many cases, there is the danger that at least in partial regions this can lead to relief formation of the galvanic layer on the pressing band. This is promoted by the fact that the pressing bands during their latter utilization in the multi-layer heating presses are subjected to strong pulling and bending loads.

In accordance with another method disclosed in the German reference DE-OS 3,337,962, after the formation of the surface structure of the pressing band by means of an electrolytic bath, an additional layer in the welding seam region is unnecessary. However, there certain problems with respect to the adhesion of the galvanically applied structure figures on the steel sheet exist.

SUMMARY OF THE INVENTION

Accordingly, it is an object of the present invention to provide a galvanic structuring of endless pressing bands, which avoids the disadvantages of the prior art.

In particular, it is an object of the present invention to provide a suitable steel alloy for the pressing bands, which has an extremely low hardness decrease in the welding seam zone.

In keeping with these objects and with others which will become apparent hereinafter, one feature of the present invention resides, briefly stated, in a method of galvanic structuring of endless pressing bands in accordance with which a steel band treated in an acid bath and having a welding seam is utilized and the steel band has the alloying ingredients:

| | |
|---|---|
| Carbon | 0–0.03% |
| Silicon | 2–4% |
| Manganese | 0.15–0.5% |
| Chromium | 11–14% |
| Nickel | 6–8%. |

When the steel bands with the above specified steel alloy were compared with other alloys, it has been found in a surprising manner that the utilization of such steel alloys for welded endless pressing bands after the galvanic removing, provides a structuring in the welding seam zones such that different sample bands have identical results. It should be especially noticed that this positive result is also obtained with insignificantly deviating alloying fractions or deviating mixing ratios of the immersion bath acids.

The novel features which are considered as characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

In accordance with the present invention, a galvanic structuring of endless pressing bands is performed with the use of a steel band which is treated in an acid bath and has a welding seam. In accordance with the inventive features, the steel band has the following alloying ingredients:

| | |
|---|---|
| Carbon | 0–0.03% |
| Silicon | 2–4% |
| Manganese | 0.15–0.5% |
| Chromium | 11–14% |
| Nickel | 6–8%. |

As specified above it has been shown that different sample bands composed of the above specified alloy have identical structuring after the galvanic removing.

A specific alloy in accordance with the present invention can have the following composition:

| | |
|---|---|
| Carbon | 0.01% |
| Silicon | 3% |
| Manganese | 0.25% |
| Chromium | 13% |
| Nickel | 7.3% |

Especially good results are obtained when in accordance with the present method an acid bath has the following composition:

| | |
|---|---|
| Phosphorus portion | 40–50% |
| Sulfuric acid portion | 30–40%. |

In accordance with a specific example of the acid bath the phosphorus portion is for example 45%, while the sulfuric acid portion is 34%.

In accordance with a further inventive feature of the pressing method, the acid bath is subjected to the action of a direct current with a current density 3 ampere/dm$^2$.

In accordance with a further inventive aspect of the method the inner side, the outer side, or both sides of the band are galvanically treated. It is especially advantageous when the pressing bands for structuring are subjected to the acid action in the immersion bath during 30–60 minutes. In this case a structuring depth of 30–60 thousandth millimeters is obtained.

An example of the procedure for producing and treating of such a steel band is presented hereinbelow.

A pressing band of a desired length is first taken from a steel band coil with an alloying composition in accordance with the present invention, and the welding butt points are cut straight or inclinedly. The steel band coil in many cases are ground at both sides, or in other words is free of fuse or corrosion defects. Different methods can be used for welding. Frequently, a known process is used under the name WIG process. After this the welding seam and the whole outer and inner surfaces of the pressing band are ground to a uniform material thickness. The finely ground outer surface is then finely polished to a roughness equal to or smaller than 1 mu. Then the outer side of the band is imprinted with the desired design pattern which uniformly covers the whole outer surface and the printing pattern forms a seamless transition at the printing start and printing end. The thusly prepared pressing band is suspended in an acid inversion bath in which the metal-blank locations between the pressing patterns are dissolved. The action of the acid is dependent on the desired structuring depth. Eventual ridge formations in the etched structure are removed with a polishing roller, and then the pressing band is withdrawn from the immersion bath. Later the structured band is provided with a hard chromium layer in another immersion bath. This layer can be applied for example by sand blasting with a uniform gloss value.

It will be understood that each of the elements described above, or two or more together, may also find a useful application in other types of methods differing from the types described above.

While the invention has been illustrated and described as embodied in a method of galvanic structuring of endless pressing bands, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of galvanic structuring of endless pressing bands, including the steps of providing a steel band having a weld seam; treating the steel band in an acid bath; and selecting the steel band with the following alloying ingredients:

| | |
|---|---|
| Carbon | 0–0.03% |
| Silicon | 2–4% |
| Manganese | 0.15–0.5% |
| Chromium | 11–14% |
| Nickel | 6–8%, |
| and a balance of iron. | |

2. A method as defined in claim 1, wherein the alloying ingredients of the steel band are:

| | |
|---|---|
| Carbon | 0.01% |
| Silicon | 3% |
| Manganese | 0.25% |
| Chromium | 13% |
| Nickel | 7.3% , |
| and a balance of iron. | |

3. A method as defined in claim 1; and further comprising the step of selecting the acid bath of the following composition:

| | |
|---|---|
| Phosphorus portion | 40–50% |
| Sulfuric acid portion | 30–40%. |

4. A method as defined in claim 3, wherein said acid bath has the following composition:

| | |
|---|---|
| Phosphorus part | 45% |
| Sulfuric acid part | 34%. |

5. A method as defined in claim 1; and further comprising the step of subjecting the acid bath to the action of direct current with a current density of 3 ampere/$dm^2$.

6. A method as defined in claim 1, wherein said treating includes galvanically treating an inner side of the steel band.

7. A method as defined in claim 1, wherein said treating includes galvanically treating an outer side of the steel band.

8. A method as defined in claim 1, wherein said treating includes galvanically treating an inner and an outer sides of the steel band.

9. A steel band for galvanic structuring of endless pressing bands having a welding seam and treated in an acid bath, comprising the following alloying ingredients:

| | |
|---|---|
| Carbon | 0–0.03% |
| Silicon | 2–4% |
| Manganese | 0.15–0.5% |
| Chromium | 11–14% |
| Nickel | 6–8%, |
| and a balance of iron. | |

* * * * *